US007338046B1

(12) United States Patent
Pohlman, Jr.

(10) Patent No.: US 7,338,046 B1
(45) Date of Patent: Mar. 4, 2008

(54) MULTIPLE TETRAHEDRON PICTURE DISPLAY SYSTEM

(76) Inventor: Robert L. Pohlman, Jr., 2629 W. 23rd St., Suite 1, Panama City, FL (US) 32405

( * ) Notice: Subject to any disclaimer, the term of this patent is extended or adjusted under 35 U.S.C. 154(b) by 0 days.

(21) Appl. No.: 11/453,793

(22) Filed: Jun. 16, 2006

(51) Int. Cl.
*A63F 9/08* (2006.01)

(52) U.S. Cl. ..... 273/157 R; 273/156

(58) Field of Classification Search ..... 273/157 R, 273/153 S, 156; 434/403; 446/118
See application file for complete search history.

(56) References Cited

U.S. PATENT DOCUMENTS 1,709,660 A * 4/1929 De Bracht ..... 273/157 R
2,041,030 A * 5/1936 Strutton ..... 273/157 R
3,464,145 A * 9/1969 Martin ..... 446/118
3,608,906 A 9/1971 Older
4,133,538 A * 1/1979 Ambrose ..... 273/276
4,257,609 A * 3/1981 Squibbs ..... 273/241
4,974,849 A * 12/1990 Kasuya et al. ..... 273/157 R
4,995,813 A * 2/1991 Francioni ..... 434/96
5,176,521 A * 1/1993 McRae ..... 434/407
5,711,524 A * 1/1998 Bauer et al. ..... 273/157 R
D414,613 S 10/1999 Pohlman, Jr.

* cited by examiner

*Primary Examiner*—Steven Wong
(74) *Attorney, Agent, or Firm*—William B. Noll

(57) ABSTRACT

A picture display system, such as for a table top display, utilizing a plurality of tetrahedronal shaped blocks which feature four planar faces of equilateral triangles. In the system, the blocks are positioned within a tray-like housing, preferably six-sided, where the housing includes a base or floor having an array of tetrahedronal shaped recesses or pegs for strategically positioning the respective blocks to expose one of the triangular faces, with each face having a picture segment. With the blocks so positioned, the picture segments reveal a full or completed picture.

5 Claims, 2 Drawing Sheets

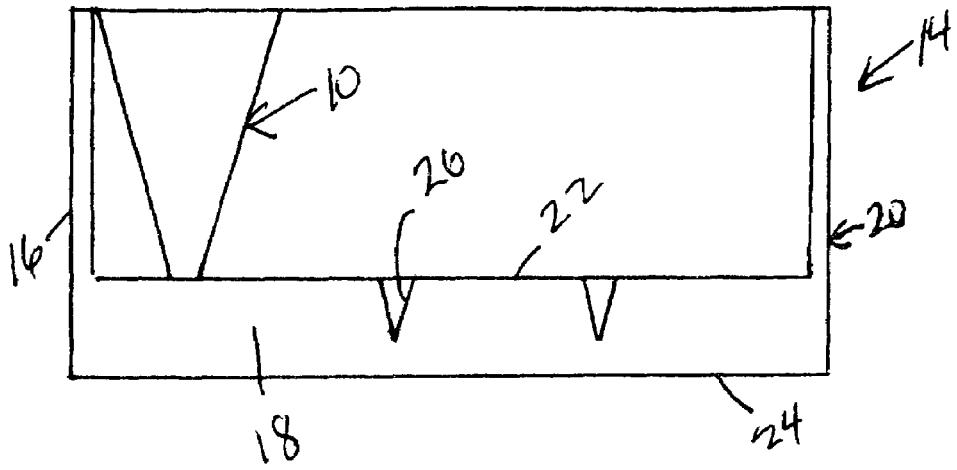
Fig. 3
Fig. 1
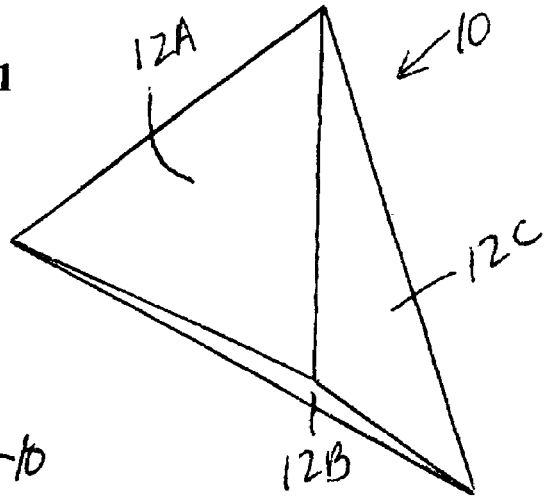
Fig. 5
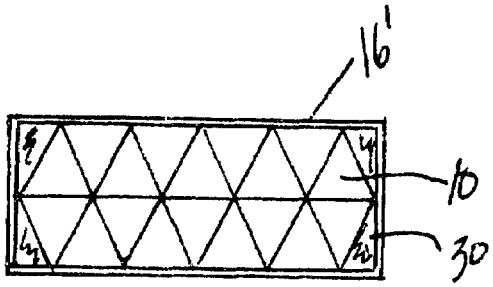
Fig. 6
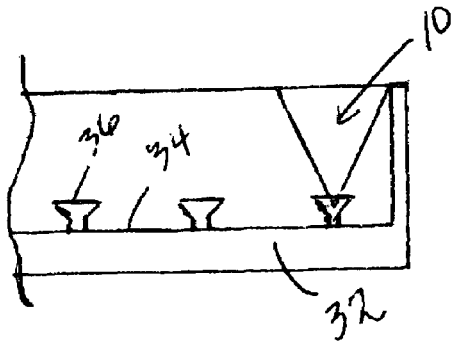

MULTIPLE TETRAHEDRON PICTURE DISPLAY SYSTEM

FIELD OF THE INVENTION

This invention is directed to the field table top picture display systems, by way of example, more particularly to a system that uses multiple, tetrahedron shaped blocks, featuring four faces of equalateral triangles, whereby the selective placement of the blocks exposes a first planar face of said blocks upon which a picture may be displayed.

BACKGROUND OF THE INVENTION

The present invention relates to a unique arrangement for displaying multiple pictures by the selective use of tetrahedral shaped blocks positioned side-by-side within a frame-like tray. The system hereof represents an improvement over the multi-cubed picture display system disclosed and illustrated in U.S. Pat. No. D-414,613, by the inventor hereof. Each said system offers the user a convenient and unique manner to display multiple picture segments in an array of such segments to reveal a single pictoral rendition. By turning and rearranging the blocks to expose second faces of the blocks, the user will reveal a second pictorial rendition. The number of such renditions is limited only by the number of faces on the blocks. The prior art system is composed of a rectangular, tray-like frame into which multiple cubes are placed to reveal an array of cubes having a planar surface that may contain a segmented picture. With the cubes having six square faces, one merely has to rotate the array of cubes for a second, third, etc. segmented picture. Such an arrangement represents a convenient table top display item that can become a challenging puzzle to a guest, for example, or merely a way of showing a variety of family photographs, etc.

An early effort to provide a three dimensional picture/puzzle system is described and illustrated in U.S. Pat. No. 3,608,906, to Odler. The system thereof includes a support which is preferably a polyhedron and has portions adapted to receive the puzzle pieces such that the completed puzzle formed by the pieces arranged on the portion of the polyhedron is substantially that of the polyhedron.

The instant invention is unique in its construction in that it uses multiple, equally dimensioned, tetrahedral shaped blocks that interfit within a supporting tray-like frame to present an array of planarly arranged blocks, each having a picture segment, with a planar surface that may bear a continuous picture of the arranged picture segments, for instance. Rearranging such blocks allows the user to expose up to four full or continuous pictures. The manner by which this invention is distinguished from the prior art will become more apparent in the description which follows, particularly when read in conjunction with the accompanying drawings.

SUMMARY OF THE INVENTION

This invention teaches a unique picture display system, such as for display on a coffee table, or the like, where the system allows the user to easily change the pictoral display, up to four different picture renditions. Further the system may function as a puzzle for one not familiar with the pictures. In either case, the system hereof includes a plurality of tetrahedron blocks, i.e. four sided, three dimensional objects having four equilateral triangle faces, where the respective triangles, all edges being equal, may be decorated with picture segments. To arrange the various picture segments into a completed or full picture, the blocks, picture facing up, a tray-like housing is provided. The housing comprises a base or floor for receiving the respective blocks and a continuous wall upstanding therefrom, where the wall has six straight sections, each wall segment being essentially a multiple of the block edge, i.e. 1×, 2×, 3×, etc. The base or floor is characterized by an array of tetrahedronal shaped recesses for receiving the apex of the block opposite the triangle face containing the selected picture segment. To fill the tray-like housing, the user selects the desired picture segments for each set of plural blocks and begins to insert them into the respective recesses. As the picture begins to take shape, it will be noted that the array of blocks will come together and snugly fit to an adjacent block within the wall sections. The result is a planar surface revealing the complete or full picture. When the user desires to reveal a different picture, he/she merely realigns or turns the blocks for the different picture.

Accordingly, a feature of this invention is to provide the user with a convenient table top picture display system, a system that can be easily changed to a different display.

An alternative feature hereof is a picture display that may be used as a challenging puzzle for those not familiar with the different pictures.

Still another feature of the invention is the provision of employing a plurality of tetrahedronal shaped blocks to display a picture formed by plural picture segments.

A further feature hereof lies in the use of a six-sided tray-like housing to receive and position the picture segments into a full or complete picture.

Another feature of this invention lies in the use of a tray-like housing having a base or floor containing an array of tetrahedronal shaped recesses for positioning the blocks with the pictoral face upward.

These and other features of the invention will become more apparent in the description which follows, particularly when read in conjunction with the accompanying drawing.

BRIEF DESCRIPTION OF DRAWINGS

FIG. 1 is an enlarged perspective view of a tetrahedral block, having four sides with each an equilateral triangle, for use in the system of this invention.

FIG. 3 is an enlarged sectional view taken along line 3-3 showing the housing and base, where the base shows a pair of said recesses.

FIG. 5 is a top view of an alternate elongated housing shape for practicing the invention.

FIG. 6 is a partial sectional view of a modified base utilizing a "tee" element for receiving and supporting a block of the invention.

DETAILED DESCRIPTION OF PREFERRED EMBODIMENT

The present invention teaches a unique picture display system that may be placed on a table top, such as a coffee table, to display up to four different pictures. Alternately, it could be used as a challenge to puzzle solvers. In any case, the system of this invention relies on the strategic placement of a plurality of tetrahedral shaped blocks to reveal the complete or full picture. The manner of using such blocks to present a picture will become more apparent from the following description and drawings.

FIG. 1, for convenience in understanding the invention, is a perspective view of a tetrahedron shaped block 10, as known in the art, where the block is characterized by four planar, equilateral triangular faces 12A, 12B, 12C, with the fourth face 12D hidden, each face containing three 60° angles, and an edge dimension of "A". Further, each said face may be provided with a picture segment as will become clearer with regard to FIGS. 2 and 4.

Figure 2:
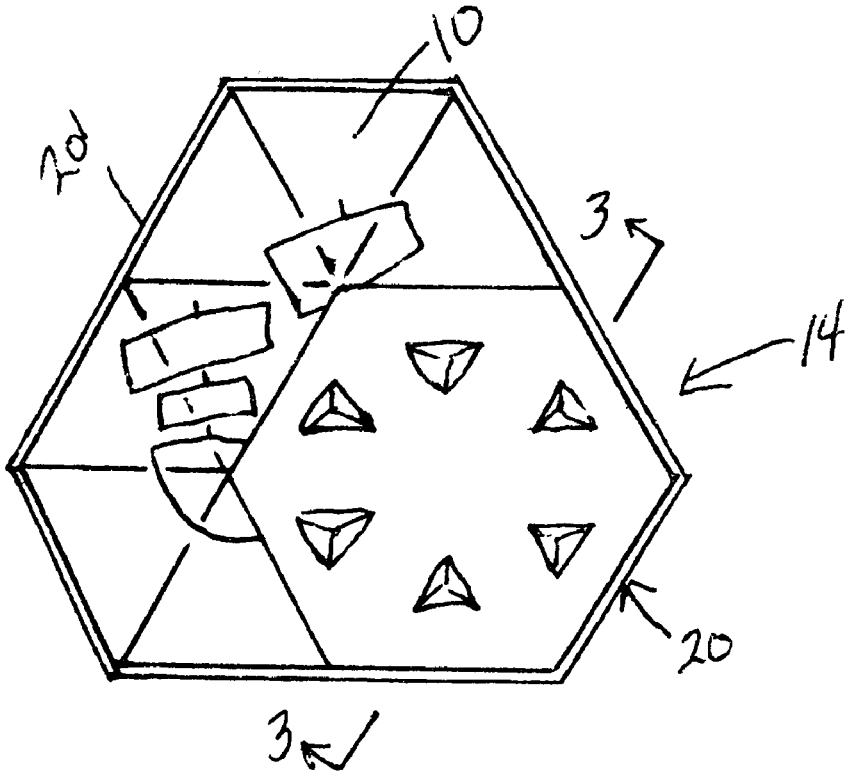
FIG. 2 is a top view of a partially completed picture display system of the invention, where the system includes a multi-sided tray-like housing with a base or floor having an array of angled recesses for seating the plural tetrahedral blocks and position same to reveal a picture.

FIGS. 2 and 3 illustrate additional details of the system 14 of this invention. Such system comprises a tray-like housing 16 consisting of a base or floor 18 and a continuous wall 20 upstanding therefrom, where the wall is of a height to fully receive and accommodate the blocks 10, as discussed later. The wall preferably consists of six sections, an exemplary section identified as 20', where each said section has an inside length essentially equal to a multiple of the dimension "A", namely, 1×, 2×, 3×, etc. While it may not make an esthetic appearance, there can be additional sections, such as eight, ten, or multiples of two. In any case, as will be apparent from FIGS. 2 and 4, the angle between adjacent sections is about 120° for the preferred shape of six sections. By this arrangement the blocks 10 will fit snugly and adjacent the inner side of the wall 20. The preferred construction of the base or floor 18, as best illustrated in FIG. 3, has a top and bottom surface, 22 and 24, respectively, and an array of tetrahedral shaped recesses 26 extending downward from the top surface 22, where the respective recesses 26 receive and support a selected said block 10. With the apex of a block seated in the recess, the opposite surface, i.e. 12A, 12B, 12C or 12D is exposed in a planar manner as seen in FIG. 2. As the blocks 10 are placed within the tray-like housing 16, specifically within the recesses 26, the picture begins to develop, see FIG. 2.

Figure 4:
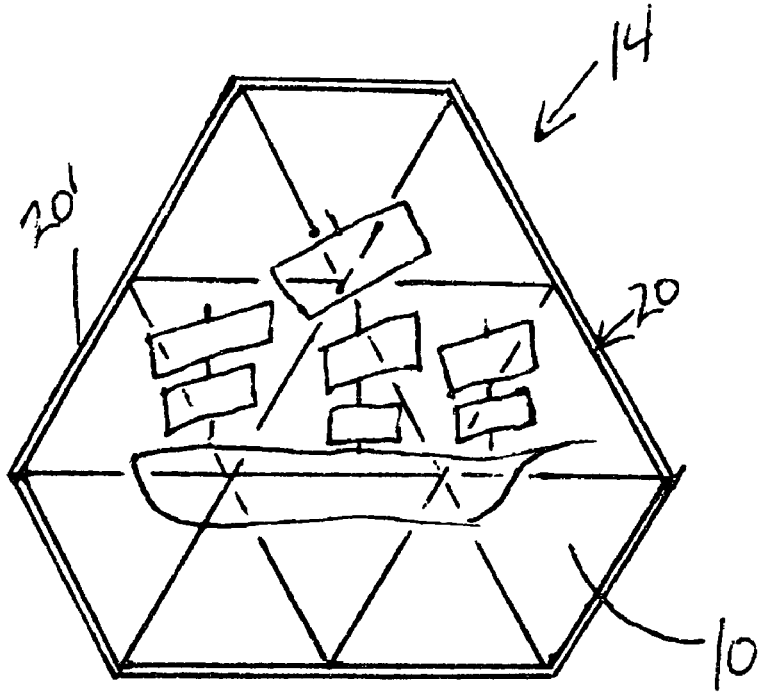
FIG. 4 is a top view similar to FIG. 2 showing a completed picture display system according to the present invention.

FIG. 4 illustrates the completed picture or puzzle. By the use of a tetrahedral shaped block 10, with four triangular surfaces, the owner or user can present four different pictures, merely by rotating the respective blocks and positioning them at the desired location.

FIG. 5 is a top view of an alternate housing, where the housing 16' is rectangular in shape with the end walls 30 are angled inwardly to contact the blocks 10. Another modification for the construction of the invention is illustrated in FIG. 6. The base 32, extending upward from the top surface 34, may be modified to include plural "tees" 36 or peg-like elements, mounted within the base 32, to receive and support the blocks 10.

It is recognized that changes, variations and modifications may be made to the picture display system of this invention without departing from the spirit and scope thereof, such as by the addition of a cover with a transparent top as shown in the prior art, U.S. Pat. No. D414,613. Accordingly, no limitation is intended to be imposed thereon except as set forth in the accompanying claims.

I claim:

1. A picture display system to allow the presentation of four separate and distinct pictures, said system comprising:

a.) a plurality of tetrahedral shaped blocks, each block consisting of four equilateral triangular faces bearing a picture segment, with the edges of said blocks a predetermined length;

b.) a housing body featuring a base having a top and a bottom surface, and a continuous upstanding wall extending therefrom and defined by a continuous edge, said housing body further characterized by i) said wall formed of multiple sections, each section having an inside dimension essentially equal to a multiple of said predetermined length; and, ii) said base having an array of tetrahedronal shaped recess means vertically spaced from said bottom surface to a position below said upper edge for receiving a said tetrahedral shaped block, and further including a plurality of pegs adapted to support each respective said block, whereby selective positioning of said tetrahedronal blocks will reveal a planar surface with the picture segments forming a completed and continuous picture.

2. The picture display system according to claim 1, wherein the angle between adjacent said wall sections is about 120°.

3. The picture display system according to claim 1, wherein the height of said wall is sized to fully receive said positioned blocks.

4. The picture display system according to claim 1, wherein there are six wall sections.

5. The picture display system according to claim 1, wherein said recess means extend downwardly into said base.

* * * * *